United States Patent [19]

von der Eltz et al.

[11] 4,052,156

[45] Oct. 4, 1977

[54] PROCESS FOR THE CONTINUOUS DYEING OF WOOL WITH METHYL TAURINO-ETHYLSULFONE DYES

[75] Inventors: Hans-Ulrich von der Eltz, Frankfurt am Main; Joachim Walter Lehmann, Kelkheim/Taunus, both of Germany

[73] Assignee: Hoechst Aktiengesellschaft, Frankfurt am Main, Germany

[21] Appl. No.: 495,295

[22] Filed: Aug. 6, 1974

[30] Foreign Application Priority Data

Aug. 8, 1973 Germany ..... 2340044

[51] Int. Cl.[2] ..... D06P 5/17; D06P 3/10; D06P 1/38; D06P 3/82

[52] U.S. Cl. ..... 8/22; 8/26; 8/41 R; 8/54; 8/82; 8/86

[58] Field of Search ..... 8/54, 1 C, 1 D, 82, 8/86, 74, 41 B, 22, DIG. 15, 1 B

[56] References Cited

U.S. PATENT DOCUMENTS

| | | | |
|---|---|---|---|
| 3,185,538 | 5/1965 | Voltz | 8/45 |
| 3,326,887 | 6/1967 | Riat | 260/153 |
| 3,652,200 | 3/1972 | Miyasaka | 8/54 |
| 3,671,181 | 6/1972 | Feess | 8/165 |
| 3,792,975 | 2/1974 | Kallay | 8/41 A |

FOREIGN PATENT DOCUMENTS

| | | | |
|---|---|---|---|
| 611,482 | 12/1960 | Canada | 8/15 |
| 1,544,583 | 10/1968 | France | 8/16 |

OTHER PUBLICATIONS

Marsden, J., Am. Dyestuff Reporter, Apr. 1969, pp. 35–40.

*Primary Examiner*—Christopher A. Henderson
*Attorney, Agent, or Firm*—Curtis, Morris & Safford

[57] ABSTRACT

A process for the continuous dyeing of textile materials consisting of or containing wool with reactive dyestuffs according to a steam fixation method, by impregnating the fibrous material at pH values of from 6.5 to 7.5 with an aqueous liquor containing reactive dyestuffs of the methyltaurino-ethyl-sulphone type, and fixing the dyestuff without intermediate drying of the material by treating with saturated or largely saturated steam at temperatures of from 110° to 120° C.

3 Claims, No Drawings

PROCESS FOR THE CONTINUOUS DYEING OF WOOL WITH METHYL TAURINO-ETHYLSULFONE DYES

The present invention relates to a process for the continuous dyeing of wool.

The journal Melliand Textilberichte 1966, number 3, pages 280 ff. exposes that no system of auxiliaries is known in practice hitherto admitting Thermosol dyeings on wool. In the same article it is also mentioned that combed woollen material or fabrics may be continuously dyed with acid dyestuffs, 1:1 or 1:2 metal complex dyestuffs or chromable acid dyestuffs by adding acetic acid to the padding liquor. In this case the dyestuffs are fixed by steaming at 100° C for 5–20 minutes. The authors, however, admit that the dyestuff fixation is not carried out completely in spite of the steam operation and that it must be improved by a so-called "acid shock", i.e. the padded material is passed through a hot, acid-containing liquor. A similar statement is made in German Auslegeschrift No. 1,769,647.

In the journal Deutsche Textiltechnik 21 (1971), number 12, pages 749 ff. the article "Kontinuefarberei von Wollkammzug" reads as follows: "The dyeing is carried out as in conventional processes with acid, 1:2 metal complex, chrome and reactive dyestuffs". However, no references are made as to the type of the usable reactive dyestuffs, but formic or acetic acid are recommended as additives to the padding liquors. According to this state of the art, the dyestuff is fixed at least in an acidic steam atmosphere, considering the volatility of the aforesaid acids. The other conditions approximately correspond to those mentioned above.

Moreover, German Offenlegungsschrift No. 2,047,832 describes a process for dyeing wool with reactive dyestuffs according to an exhaustion method. In this process advantage is taken of the property of preferably methyltaurino-ethylsulphone dyestuffs that firstly exhaust salt-like onto wool in an acid medium and gradually enter into a reactive linkage with the protein fiber only at higher temperatures after splitting off of the methyltaurine, while intermediately forming the reactive vinyl sulphone form. This dyestuff class could not be used hitherto because of the short fixation time of only a few minutes required for such a continuous process.

It has now been found that textile materials consisting of or containing wool may be dyed in a continuous process according to a steam fixation method, by impregnating the fibrous material with an aqueous liquor containing reactive dyestuffs of the methyltaurino-ethylsulphone type of pH values of from 6.5 to 7.5 and by carrying out the dyestuff fixation without intermediate drying of the material by treating it with saturated or largely saturated steam at temperatures in the range of from 110° to 120° C.

According to the process of the invention the padding liquors contain in aqueous solution either methyltaurino-ethylsullphone dyestuff alone or with the addition of from 2 to 10 g/l of ammonium sulphate. From 10 to 20 g/l of sodium acetate may be added as well instead of ammonium sulphate in order to neutralize acids or alkali residues, if any, in the wool. On principle, acids are not added to the padding liquors. By proceeding in this manner, a frosting effect appears, as experience has shown, on the material due to the fact that the woollen fibers standing apart from the fibrous structure (yarn, fabric) are not dyed. This may be prevented by adding a mixture of auxiliaries known from German Auslegeschrift No. 1,769,647 consisting of alkali metal and/or alkaline earth metal salts of alkyl and/or alkylaryl sulfonic acids (component I) and addition products of alkylene oxides to aliphatic alcohols (component II). If the padding liquor risks to settle in the lower parts of the padded textile material, suitable thickening agents may be added. The dyestuffs applied are completely fixed by neutral steaming for 1 to 10 minutes, 3–5 minutes normally already being sufficient.

It is surprising that the dyestuff fixation is effected in a neutral or even weakly alkaline medium according to the new dyeing method. Hitherto an addition of acid in dyeings on wool was considered indispensable. According to the invention any addition of acids, however, considerably affects the color yield. The new method not only has the advantage that a continuous process is possible but also that the dyestuffs form a chemical bond with the fiber and that the dyeings consequently have a high fastness level, admitting even repeated washings in washing machines. The woollen textile materials are moreover distinguished by a good levelness and penetration of the dyestuffs.

According to the state of the art, the continuous dyeing of wool repeatedly caused difficulties, especially for the portion of wool in polyester-woollen blends, owing to the fact that a fixation of dyestuffs for wool was not possible within the short period available in continuous processes or required special heat treatment installations. With the process of the invention blends of polyester and woollen fibers henceforth can be dyed in a continuous process, by applying disperse dyes together with methyltaurino-ethylsulphone dyes on the textile material, by steaming the goods so treated under the conditions mentioned above in order to fix the reactive dyestuff and by carrying out a Thermosol treatment in order to fix the disperse dyestuff.

The fiber reactive dyestuffs used for preparing the dyeings according to the invention may be obtained by boiling within 1–2 minutes N-methyltaurine in an alkaline liquor with reactive dyestuffs containing the group $—SO_2—CH_2—CH_2—O—SO_3H$ once or several times. Suitable starting dyestuffs of this category belong for example to the series of the oxazine, triphenylmethane, xanthone, nitro, acridone or phthalocyanine dyestuffs, especially however to the group of metal-free or metal-containing mono- or polyazo dyestuffs or of anthraquinone dyestuffs containing at least one water-solubilizing group, as for example, the sulphonic acid or carboxylic acid group.

Disperse dyestuffs used are known products as, for example those catalogued in the Color Index, 3rd edition, vol. 2 under the disignation "Disperse dyes".

The process described above is carried out on wool as follows:

One or several methyltaurino-ethylsulphone dyestuffs are dissolved by pouring boiling water over them and are then introduced into a warm padding liquor containing auxiliaries in order to prevent the frosting effect and optionally thickening agents. Depending on the acid or alkali content of the wool, of from 2 to 10 g/l of ammonium sulphate or of from 10 to 20 g/l of sodium acetate are added and the wool to be dyed, which may be in the form of flocks, combed material or woven/knitted fabric, is then padded. The material is then steamed within 3 to 5 minutes in saturated or mostly saturated steam of advantageously 115° C without intermediate drying and the dyeing is finished by rinsing in an aqueous solution.

The following examples illustrate the invention:

EXAMPLE 1

A combed woollen material was padded giving a liquor pick-up of about 75% (calculated on the dry material) with an aqueous liquor of 50° C containing per liter: 30 g of the reactive dyestuff of the formula

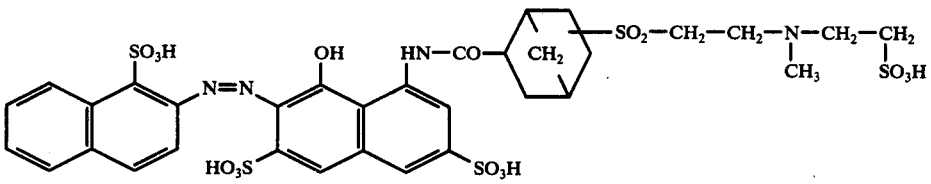

10 g of the reactive dyestuff of the formula

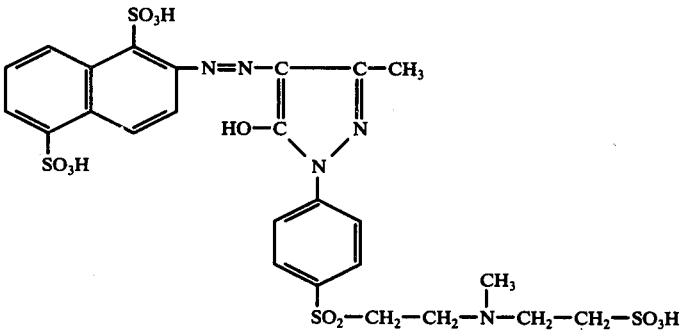

as well as auxiliaries consisting of 5 g of sodium salt of an alkane sulphonic acid having from 12 to 17 carbon atoms in the alkyl radical, 3 g of the reaction product of 1 mol of isotridecyl alcohol with 8 mols of ethylene oxide, 2.5 g of triisobutyl phosphate and 5 g of ammonium sulfate.

Immediately after padding, the material was steamed with saturated or nearly saturated steam of 115° C within 5 minutes and then rinsed with water.

A clear and level orange dyeing having excellent fastness properties was obtained.

EXAMPLE 2

A woollen fabric having a largely anti-felt finish was padded with an aqueous liquor containing per liter: 30 g of the reactive dyestuff of the formula

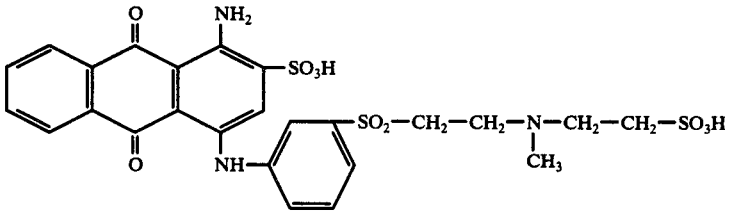

as well as a mixture of auxiliaries consisting of 10 g of sodium salt of an alkane sulphonic acid having from 12 to 17 carbon atoms in the alkyl radical, 6 g of the reaction product of 1 mol isotridecyl alcohol with 8 mols of ethylene oxide, 5 of triisobutyl phosphate and 5 g of sodium acetate.

After padding with a liquor pick-up of about 80% the material was steamed with saturated or largely saturated steam of 115° C within 3 minutes without intermediate drying and was then rinsed with water.

A blue dyeing having a good levelness and penetration as well as good fastness properties was obtained.

EXAMPLE 3

A fabric made of a blend of polyester fibers and wool in a proportion of 55:45 was padded giving a liquor pick-up of about 65% with an aqueous liquor having from 50° to 60 ° C containing per liter:

15 g of the reactive dyestuff of the formula

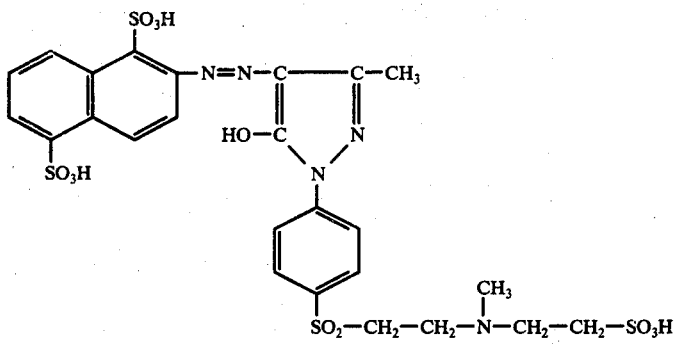

15 g of the disperse dyestuff of the formula

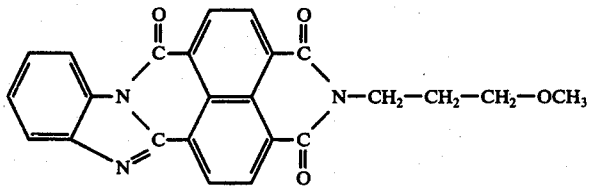

5 g of the disperse dyestuff of the formula

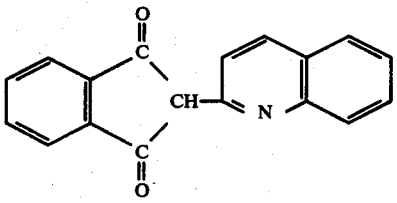

as well as a mixture of auxiliaries consisting of 5 g of sodium salt of an alkane sulphonic acid having of from 12 to 17 carbon atoms in the alkyl radical, 3 g of the reaction product of 1 mol of isotridecyl alcohol with 8 mols of ethylene oxide, 2.5 g of triisobutyl phosphate and 10 g of ammonium sulphate.

After padding, the fabric was steamed with saturated steam of 115° C within 3 minutes without intermediate drying and was then exposed to a dry heat treatment within 60 seconds at a temperature of 210° C. After rinsing with warm water the dyeing was treated for 10 minutes at 75° C in an aqueous bath containing 0.8 g/l of the reaction product of 1 mol of castor oil with 36 mols of ethylene oxide 0.8 g/l of Ca-phenylkogasin sulphonate 0.3 g/l of isopropanol and 0.5 g/l of acetic acid (60%)

and was then rinsed with warm and cold water.

A fast yellow dyeing was obtained, where the polyester fibers and the wool had a good tone-in-tone dyeing.

EXAMPLE 4

A woollen fabric was padded giving a liquor pick-up of about 80% with an aqueous padding liquor of 50° C containing per liter:

20 g of the reactive dyestuff of the formula

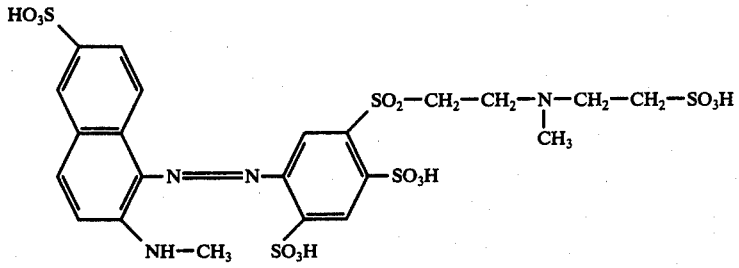

as well as a mixture of auxiliaries consisting of 5 of sodium salt of an alkane sulphonic acid having of from 12 to 17 carbon atoms in the alkyl radical, 3 g of the reaction product of 1 mol of isotridecyl alcohol with 8 mols of ethylene oxide and 2.5 g of triisobutyl phosphate.

After padding, the fabric was steamed for 3 minutes in saturated steam without intermediate drying and was then rinsed with water.

A fast red dyeing was obtained.

EXAMPLE 5

By using an aqueous solution of 50° C containing per iter 30 g of the reactive dyestuff of the formula

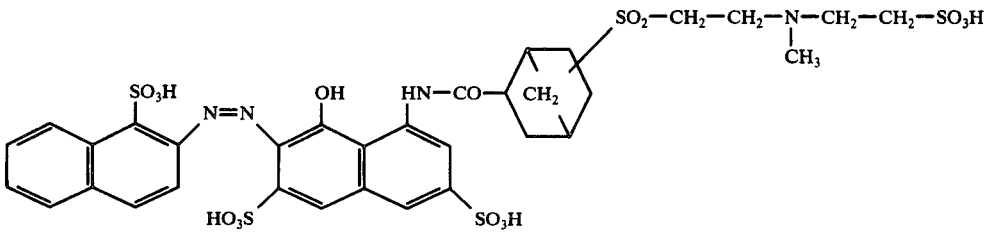

10 g of the reactive dyestuff of the formula

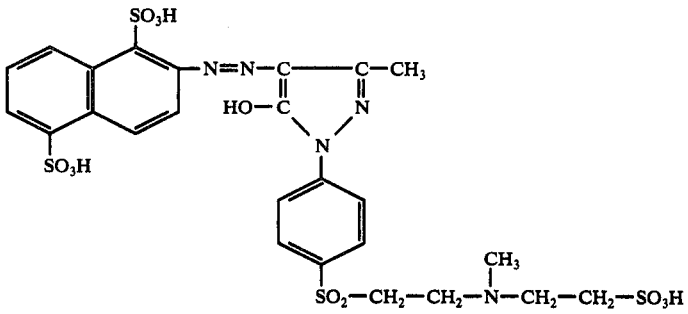

and 5 g of ammonium sulphate

A woollen fabric was padded with a liquor pick-up of 80%, treated for 5 minutes with saturated steam of 115° C and the dyeing was finished in usual manner.

A clear orange dyeing having good fastness properties was obtained.

Similar good dyeing results may be obtained by using separately each of the dyestuffs mentioned in the above Example. In this case very clear, level, red or yellow dyeings are obtained.

We claim:

1. A process for the continuous dyeing of textile materials consisting of or containing wool with a reactive dyestuff according to a steam fixation method which comprises impregnating the fibrous material at pH values of from 6.5 to 7.5 with an aqueous liquor containing a reactive dyestuff which contains a methyltaurinoethylsulphone group, and fixing the dyestuff without intermediate drying of the material by treating with saturated steam at temmperatures of from 110° to 120° C.

2. A process as claimed in claim 1, wherein blends of wool and polyester fibers are dyed as textile material.

3. A process as claimed in claim 2, wherein the padding liquors contain besides the reactive dyestuffs disperse dyestuffs and wherein the steam operation is followed by a dry heat treatment in order to fix the disperse dyestuffs.

* * * * *